United States Patent [19]

van Mullekom

[11] 4,108,214

[45] Aug. 22, 1978

[54] WEAVING LOOM WITH TENSION ADJUSTOR FOR WARP EDGE THREADS

[75] Inventor: Hubert Peter van Mullekom, Deurne, Netherlands

[73] Assignee: Ruti-Te Strake B.V., Deurne, Netherlands

[21] Appl. No.: 758,127

[22] Filed: Jan. 10, 1977

[30] Foreign Application Priority Data

Jan. 20, 1976 [NL] Netherlands ..... 7600568

[51] Int. Cl.[2] ..... D03D 49/00

[52] U.S. Cl. ..... 139/97; 139/114

[58] Field of Search ..... 139/97, 100, 114, 115, 139/35, 98, 24

[56] References Cited

U.S. PATENT DOCUMENTS

| | | | |
|---|---|---|---|
| 627,445 | 6/1899 | Robinson | 139/114 |
| 658,341 | 9/1900 | Cartier | 139/97 |
| 671,534 | 4/1901 | Bartlett | 139/97 |
| 1,817,203 | 8/1931 | Payne | 139/97 UX |
| 2,433,101 | 12/1947 | Dewas | 139/97 |
| 3,339,592 | 9/1967 | Glendinning | 139/24 X |

FOREIGN PATENT DOCUMENTS

| | | | |
|---|---|---|---|
| 307,133 | 7/1971 | U.S.S.R. | 139/97 |

*Primary Examiner*—James Kee Chi

*Attorney, Agent, or Firm*—Marshall & Yeasting

[57] ABSTRACT

A weaving loom of the type in which the back beam is mounted for carrying out a limited translational movement for compensating the variations in tension in the warp threads passing over it, which variations are caused by the periodic changes of the shed. An auxiliary guide for a plurality of warp edge threads is provided at at least one end of the back beam, said guide being mounted to carry out a translational movement, independently of the back beam, under the influence of an adjustable load imparted to it.

2 Claims, 1 Drawing Figure

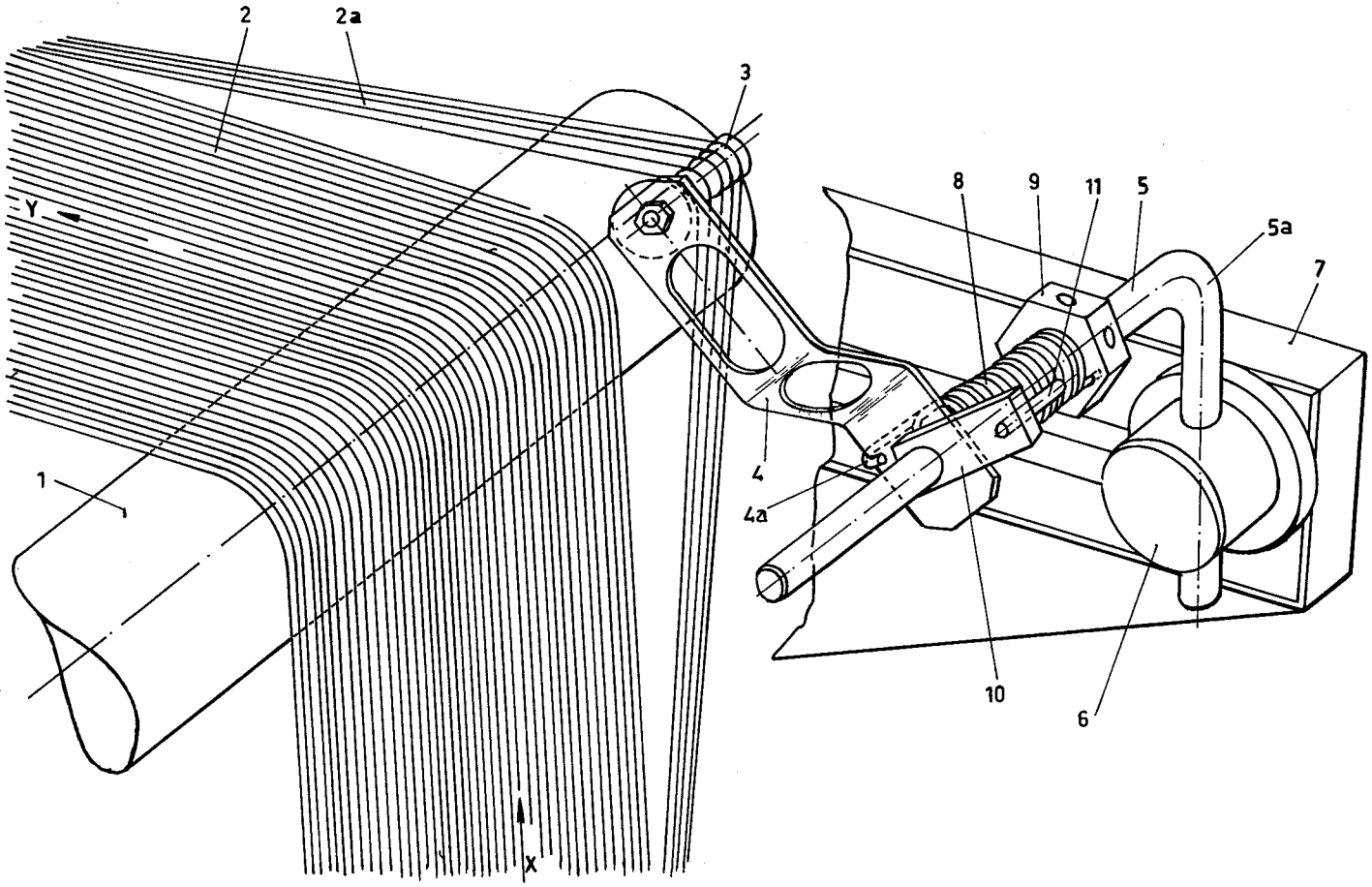
7
5a
5
11
9
8
6
10
3
4
4a
2a
2
1
X
Y

WEAVING LOOM WITH TENSION ADJUSTOR FOR WARP EDGE THREADS

The invention relates to a weaving machine of the type in which the back beam is mounted for carrying out a limited translational movement for compensating the variations in tension in the warp threads passing over it, which tension variations are caused by the periodic changes of the shed.

Weaving looms having back beams supported in the above manner are well-known. During the normal operation of such a loom, the back beam carries out, in addition to its incremental rotational movement, and up and down movement, in synchronism with the reciprocating reed movement. The corrections caused by the up and down movement of the back beam are the same all over the width of the loom, for all the warp threads. The tension fluctuations, however, are not the same for all of the warp threads. More specifically, the warp threads at the edges of the cloth to be woven show substantially larger tension fluctuations. For one of the causes thereof reference may be made to Dutch patent application No. 7,505,439 in which the tendency of "rebounding" of the cloth line after beating up movement of the reed, particularly at the cloth edges, is mentioned.

These larger tension variations in the so-called edge threads involve both the positive as well as the negative deviations with respect to the average warp tension being in said warp threads larger than in the other warp threads. This not only influences the appearance of the woven cloth but forms — in the present state of the weaving art and particularly that of weaving by means of air — a factor which is also decisive for the weaving efficiency. For it is that it is attempted to insert the weft thread as early as possible after the start of the shed change i.e. the moment in which the shed reopens, which has been closed after the beating up movement of the reed during the foregoing weaving cycle. Experiments have shown that on the side from which the weft threads are launched, particularly with "shaggy" warp threads, it often occurs that the edge threads in the initial phase of the shed change — when the tensions are lowest tend to cling together as a result of which the forming of the shed is delayed and there is a serious risk of an early launched weft thread entering into contact with said temporarily lagging edge threads which lead to weaving defects.

Said phenomenon further occurs more often in as far as the weaving shafts are situated at a larger distance from the cloth line.

In connection with the above-mentioned disadvantages, the present invention aims at providing a more stable tension situation for the warp threads adjacent the cloth edges and particularly for such warp threads that co-operate with the weaving shafts situated at a larger distance from the cloth line.

According to the present invention, an auxiliary guide for a plurality of warp threads is provided at at least one end of the back beam, said guide being mounted to carry out a translational movement independently of the back beam, under the influence of an adjustable load imparted to it. In a practical embodiment the auxiliary guide is formed by a roller having its axis parallel to that of the back beam, said roller being rotatably mounted on an arm which in turn is rotatably mounted on a shaft extending parallel to the back beam shaft and is spring-loaded in a direction turned away from the back beam.

Such an auxiliary guide can easily follow the periodic shed changes so that the tension fluctuations in the relative warp threads are considerably reduced.

The invention will be hereinafter further described with reference to the accompanying drawing showing one embodiment of the invention.

In the drawing, which only shows the portion of a weaving loom which is directly related to the invention, the back beam is indicated at 1 and is supported in a well-known manner (not shown in the drawing) such that in operation it is adapted to carry out a limited translational movement (e.g., according to the double arrow in the drawing).

The warp threads arriving in the direction of the arrow *x* from the warp beam (not shown) are indicated at 2 and are guided by the back beam 1 according to the arrow *y* in the direction of the weaving shafts (which are neither shown).

A plurality of warp threads 2*a* situated adjacent the edge of the cloth to be woven are guided along an auxiliary guide 3. The auxiliary guide 3, e.g., comprises a roller provided with guiding grooves, which roller is rotatably connected at one end to a swinging arm 4. The axis of the guide roller 3 extends parallel to that of the back beam 1. The swinging arm 4 is rotatably mounted on a supporting rod 5 extending parallel to the axis of the back beam 1 and of the guide roller 3. An end portion 5*a* of the rod 5 is bent downwardly at right angles and extends through a radial bore of a clamping screw 6 by means of which the rod is secured to the frame 7 of the weaving loom. The supporting rod 5 carries a torsion spring 8 one end of which, at 4*a*, engages the swinging arm 4 and the other end of which engages a spring tensioning means 9 connected to the supporting rod. The torsion spring 8 is preloaded by turning the spring tensioning means 9 clockwise, as seen in the drawing, while retaining the swinging arm 4. Said preload, which tends to turn the swinging arm to the right is in balance with the combined forces imparted by the warp threads or edge threads 2*a* to the guide roller 3 and tending to turn the swinging arm 4 anti-clockwise. The preload of the torsion spring 8 is therefore a criterion for the tension in the individual edge threads 2*a*.

A fixed arm 10 is provided on the supporting rod 5. This arm has a stop 11 for limiting the stroke of the swinging arm 4 when — e.g. if the warp beam is to be replaced — no warp threads are guided by the guide roller 3.

It will be clear that in a manner known per se one or more of the edge threads 2*a* may co-operate with auxiliary threads for selfedge forming purposes.

Of course it is also possible to use separate auxiliary guide rollers to guide those warp threads which co-operate with the weaving shafts situated at a larger distance from the cloth line.

I claim:

1. A weaving loom in which the back beam is mounted for carrying out a limited translational movement for compensating the variations in tension in the warp threads passing over it, which variations are caused by the periodic changes of the shed, characterized in that an auxiliary guide for a plurality of warp edge threads is provided at at least one end of the back beam for adjusting tension deviations in the edge threads with respect to the average warp thread tension, said guide being mounted to carry out a translational movement, independently of the back beam, under the influence of an adjustable load imparted to it, and said guide being formed by a roller, the axis of which extends parallel to that of the back beam, said roller being rotatably mounted on an arm which in turn is rotatably mounted on a shaft extending parallel to the back beam axis and is spring-loaded in the direction turned away from the back beam.

2. A weaving loom according to claim 1, characterized in that the spring is a torsion spring provided around the supporting shaft of the arm, one end of said spring engaging the arm and the other end of the spring being in engagement with a spring tensioning means adjustably provided on the supporting shaft.

* * * * *